US008100319B2

(12) United States Patent
Wittmeyer, Jr. et al.

(10) Patent No.: US 8,100,319 B2
(45) Date of Patent: Jan. 24, 2012

(54) FILE FOLDER

(75) Inventors: Larry E. Wittmeyer, Jr., Lake Lotawana, MO (US); John Borri, Collinsville, IL (US); Donna Ferguson, Elsberry, MO (US)

(73) Assignee: Cardinal Brands, Inc., Lawrence, KS (US)

( * ) Notice: Subject to any disclaimer, the term of this patent is extended or adjusted under 35 U.S.C. 154(b) by 1208 days.

(21) Appl. No.: 11/676,458

(22) Filed: Feb. 19, 2007

(65) Prior Publication Data

US 2008/0197174 A1 Aug. 21, 2008

(51) Int. Cl.
*B65D 37/00* (2006.01)
*B65D 27/00* (2006.01)
*B65D 27/12* (2006.01)

(52) U.S. Cl. ..... 229/67.4; 229/67.3; 229/76

(58) Field of Classification Search ..... 229/67.4, 229/67.3, 76, 84; 206/554, 472, 474; 402/73
See application file for complete search history.

(56) References Cited

U.S. PATENT DOCUMENTS 526,799 A * 10/1894 Barnard ..... 229/75
783,365 A 2/1905 Coleman
1,529,264 A 5/1921 Mayers
1,507,433 A * 9/1924 Schaffert ..... 40/359
1,600,345 A * 9/1926 Littman ..... 383/10
1,977,779 A * 10/1934 Southworth ..... 206/215
2,077,664 A * 4/1937 Beardsley ..... 206/451
2,450,558 A * 10/1948 Ogren ..... 206/215
3,570,752 A * 3/1971 Sczesniak ..... 229/75
3,612,264 A * 10/1971 Trunick ..... 206/449
3,785,478 A * 1/1974 Drori ..... 229/115
4,109,850 A 8/1978 Meenan et al.
4,473,153 A * 9/1984 Colangelo ..... 206/312
4,549,688 A 10/1985 Ozmon et al.
4,602,734 A 7/1986 Thompson
5,125,561 A * 6/1992 Idstein ..... 229/400
5,626,368 A 5/1997 St. Romain
5,711,750 A 1/1998 Christensen et al.
5,833,063 A * 11/1998 Ho ..... 206/308.1
5,996,881 A 12/1999 Smith
6,138,900 A 10/2000 Zeiler
6,453,589 B1 9/2002 Schwartz
2008/0023352 A1 * 1/2008 Creed ..... 206/232

* cited by examiner

*Primary Examiner* — Jes F Pascua
(74) *Attorney, Agent, or Firm* — Stinson Morrison Hecker LLP

(57) ABSTRACT

A file folder having an index tab and an interior pocket capable of containing loose papers within the file folder, wherein a front cover of the file folder may be inserted into the interior pocket to releaseably secure the file folder in a closed position.

10 Claims, 9 Drawing Sheets

FILE FOLDER

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

This invention relates generally to office accessories and, more particularly, to a file folder having an interior pocket for securing loose papers and retaining the folder in a closed position. The present invention is also directed to a method of using the file folder wherein the file folder is releaseably secured into a closed position and a method of manufacturing the file folder from a single sheet of material.

There are numerous types of file folders available for home or business organization and filing. The most common type of file folder is the standard card stock file folder into which papers may be placed having an index tab on one side of the folder for identification and organization purposes. While the standard file folder does assist in organizing one's papers, it does not secure the loose papers inside the file folder. Consequently, it is not uncommon for the papers to fall out of the file folder during insertion or removal of the file folder from a filing box or when carrying the file folder, particularly when there are a large number of papers in the file folder.

In order to secure loose papers within a file folder, it is well known to punch holes in the top or side of the loose papers and to secure the papers within the file folder by means of metal clasps and the like. Unfortunately, utilization of these known metal clasps requires destruction of the original quality and format of the papers because of the need to punch holes in the papers for insertion of the metal clasps.

Accordingly, the present invention provides several variations of file folders wherein the folder provides at least one interior pocket formed integrally with the file folder for retaining the papers and that enables the folder to be releaseably secured in a closed position. The file folder and pocket preferably being expandable to securely contain a large number of loose papers.

BRIEF SUMMARY OF THE INVENTION

The present invention provides a file folder for securing loose papers inside the folder, wherein the folder comprises an integral pocket for holding the papers and for releaseably securing the folder in a closed position. The file folder is preferably constructed of a single elongate sheet of material comprising a first body section connected to a second body section along at least one central fold line. An overlap section is connected to the second body section along at least one pocket fold line. The overlap section is folded over a portion of the second body section along the at least one pocket fold line and secured in place to thereby form a pocket. Loose papers may be placed within the pocket with a portion of the papers positioned between the second body section and the overlap section. The first body section is folded over the second body section along the at least one central fold line and inserted into the pocket such that a portion of the second body section is positioned between the overlap section and any papers stored within the pocket. In this manner, the folder is releaseably secured in a closed position.

In a preferred embodiment, the sheet is cut to form an index tab extending adjacent the fold line between the body section and the overlap section. In this manner, when the overlap section is folded over the front of the body section, the index tab will remain extending outwardly from the body section.

In a preferred embodiment, the overlap section is secured in place using a pair of tabs extending outwardly from the sides of either the overlap section or the second body section. The tabs are folded over and secured to the opposing section from which the tabs extend (e.g. if the tabs extend outwardly from the sides of the second body section, the tabs are folded over and secured to the back of the overlap section) to thereby secure the overlap section in overlapping relationship with the second body section.

The present invention includes several embodiments wherein the file folder and the pockets may be expandable. The present invention also provides a method of manufacturing the file folders comprising die cutting the specific folder pattern from a single sheet of material, folding along specified fold lines, and adhering the securing tabs to form the pocket.

DETAILED DESCRIPTION OF PREFERRED EMBODIMENT

Figure 1:
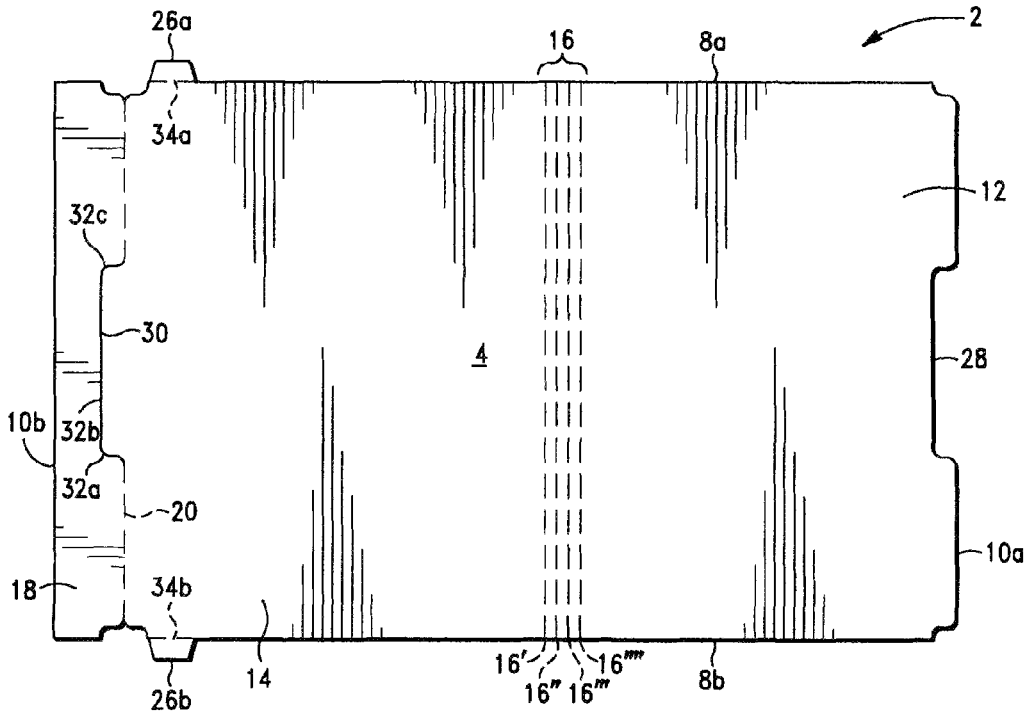
FIG. 1 is a top planar view of the unassembled file folder according to a first embodiment of the present invention.

Referring initially to FIGS. 1-5, in a first preferred embodiment of the invention, secure folder 2 is formed from a single sheet of elongate material having a front surface 4 and a back surface 6 and defined by opposing side edges 8*a*, 8*b* extending between front and back edges 10*a*, 10*b*. The folder has a plurality of sections positioned generally parallel one another along the length of the sheet. Front section 12 is connected to back section 14 along center fold section 16, and back section 14 is connected to overlap section 18 along pocket fold line 20. Overlap section 18 and a portion of back section 14 together define a pocket region 22 in which pocket 24 is formed. Pocket tabs 26*a*, 26*b* extend outwardly from side edges 8*a*, 8*b* in the pocket region 22 and are utilized to secure to the overlap section 18 to back section 14 to thereby form a secure pocket 24 upon assembly of the file folder.

Figure 5:
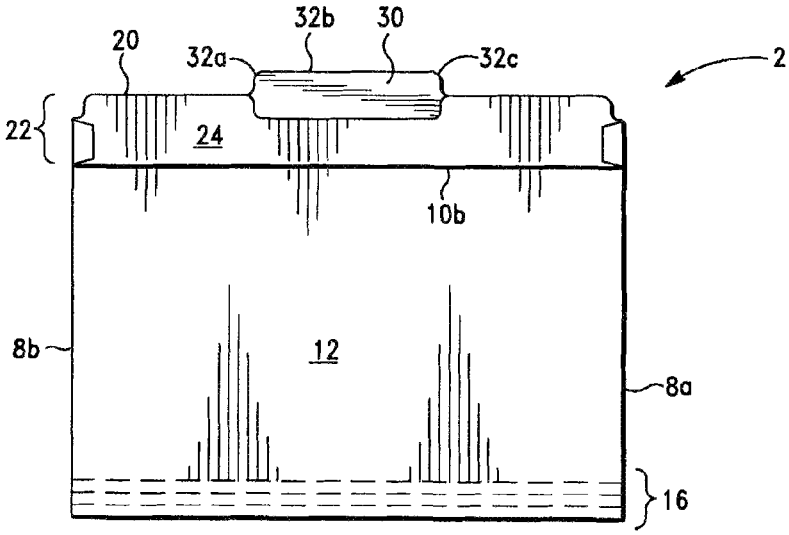
FIG. 5 is a front view of the assembled file folder of the assembled file folder of FIG. 1 in the closed position.
Figure 2:
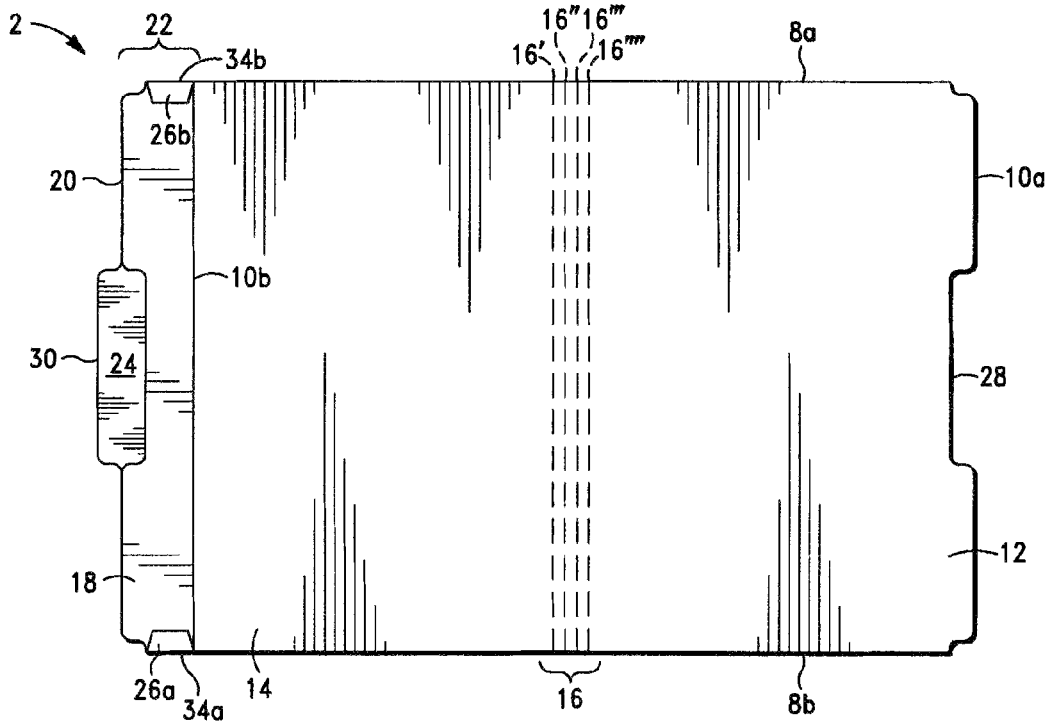
FIG. 2 is a top planar view of the assembled file folder of FIG. 1.

Front section 12 is generally rectangular in shape and defined by opposed side edges 8*a*, 8*b*, extending from front edge 10*a* to center fold section 16. Cut out notch 28 near the center of front edge 10*a* enables index tab 30 to be viewed when file folder 2 is assembled. Notch 28 is approximately ⅓ the length of front edge 10*a*. The corners of front edge 10*a* are preferably detail cut into a flattened "S" shape, as best shown in FIGS. 1, 2 and 5.

Back section 14 is generally rectangular in shape and defined by opposed side edges 8*a*, 8*b* extending from center fold section 16 to pocket fold line 20. As shown in FIGS. 1 and 2, center fold section 16 is comprised of 4 individual scored fold lines 16', 16", 16''', 16'''' to enable the material to fold at one or more of the scored fold lines for expansion. Although 4 individual scored fold lines are preferred, only 1 scored fold line is necessary. As such, more than 4 or fewer than 4 fold lines may be utilized.

Overlap section 18 is generally rectangular in shape defined by opposed side edges 8*a*, 8*b*, extending from pocket fold line 20 to back edge 10*b*. Outer corners of back section 14 and inner corners of overlap section 18—intersecting at pocket fold line 20—are preferably detail cut into a flattened "S" shape and are mirror images of each other to enable the corners to be flush when overlap section 18 is folded over back section 14 to form pocket 24. As shown in FIGS. 1 and 2, the outer corners of overlap section 18 are preferably square in shape to assist in retaining papers in pocket. It is within the scope of the present invention, however, for these corners to be rounded, detail-cut, angle-cut or virtually any shape that is easily manufactured.

Index tab 30 is located along pocket fold line 20 between back section 14 and overlap section 18 near the center of pocket fold line 20 and is approximately ⅓ the length of pocket fold line 20. Index tab 30 has 3 free edges 32*a*, 32*b*, 32*c* which are cut free from the sheet material to allow overlap section 18 to fold over onto the front of back section 14, thereby exposing index tab 30. Index tab 30 is integral with back section 14 at the base of index tab 30, and aligns with fold line 20. Index tab side edges 32*a*, 32*c* are detail cut as described above and have a flattened "S" shape. As shown in FIGS. 2 and 5 when folder 2 is assembled, index tab 30 will be located on the back section 14 of the folder and will be visible from the front of the folder through notch 28.

A pair of pocket tabs 26*a*, 26*b* extend outwardly from back section 14 along side edges 8*a*, 8*b* in close proximity to fold line 20. As shown in FIG. 1, pocket tabs 26*a*, 26*b* are separated from back section 14 by pocket tab fold lines 34*a*, 34*b* extending along side edges 8*a*, 8*b*. Pocket tabs 26*a*, 26*b* are approximately 1" wide and ½" deep and are trapezoidal in shape narrowing toward the outer edge of each pocket tab at an angle of approximately 15 degrees.

During assembly, overlap section 18 is folded along pocket fold line 20 over index tab 30 and onto the front of back section 14. Pocket tabs 26*a*, 26*b* are folded over the back of overlap section 18 along fold lines 34*a*, 34*b* and secured thereto with adhesive or other means known in the art, to form pocket 24. As shown in FIGS. 2-5, back edge 10*b* of overlap section defines an opening to the pocket for insertion of one or more sheets of paper 27 and for insertion of the front section 12 for releaseably closing the file folder.

Figure 3:
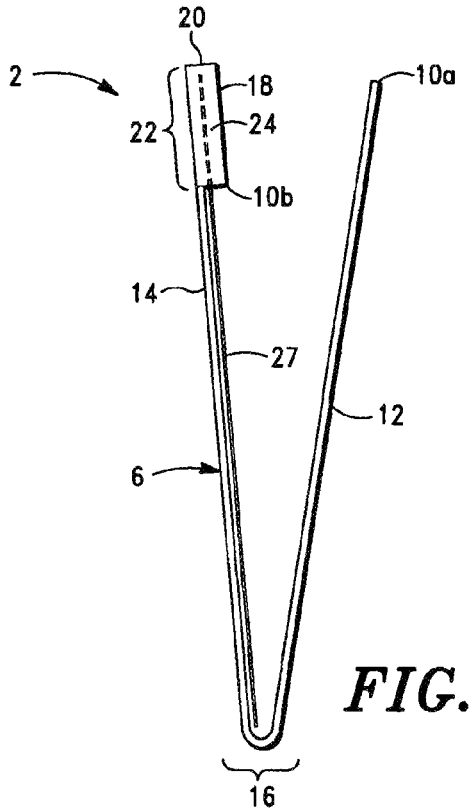
FIG. 3 is a side planar view of the assembled file folder of FIG. 1 with the file folder folded along center lines and a sheet of paper is inserted in the pocket.
Figure 4:
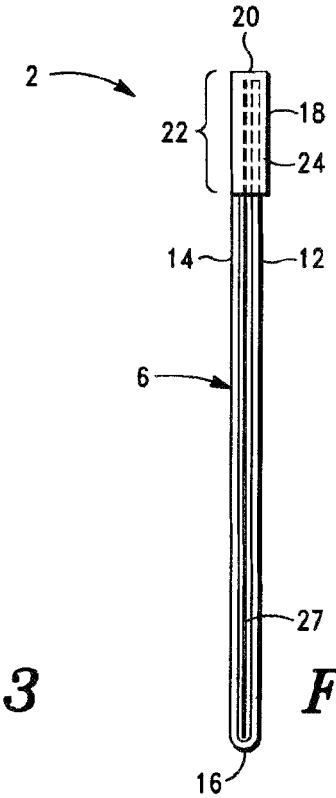
FIG. 4 is a side view of the assembled file folder of FIG. 1 with a sheet of paper inserted in the pocket and the front section of the file folder inserted into the pocket in the closed position.

As best shown in FIGS. 3 and 4, file folder 2 may be placed in an open position (FIG. 3) wherein the front section 12 is folded over the rear section 14 along the center fold section 16. A sheet of paper 27 may be inserted into pocket 24 with a portion of sheet 27 positioned between overlap section 18 and back section 14. File folder 2 may also be releaseably secured into a closed position (FIG. 4) wherein the front edge 10*a* of front section is inserted into the pocket 24. A portion of front section 12 is positioned between the sheet 27 and the overlap section 18 to secure the sheets 27 within the file folder.

Figure 6:
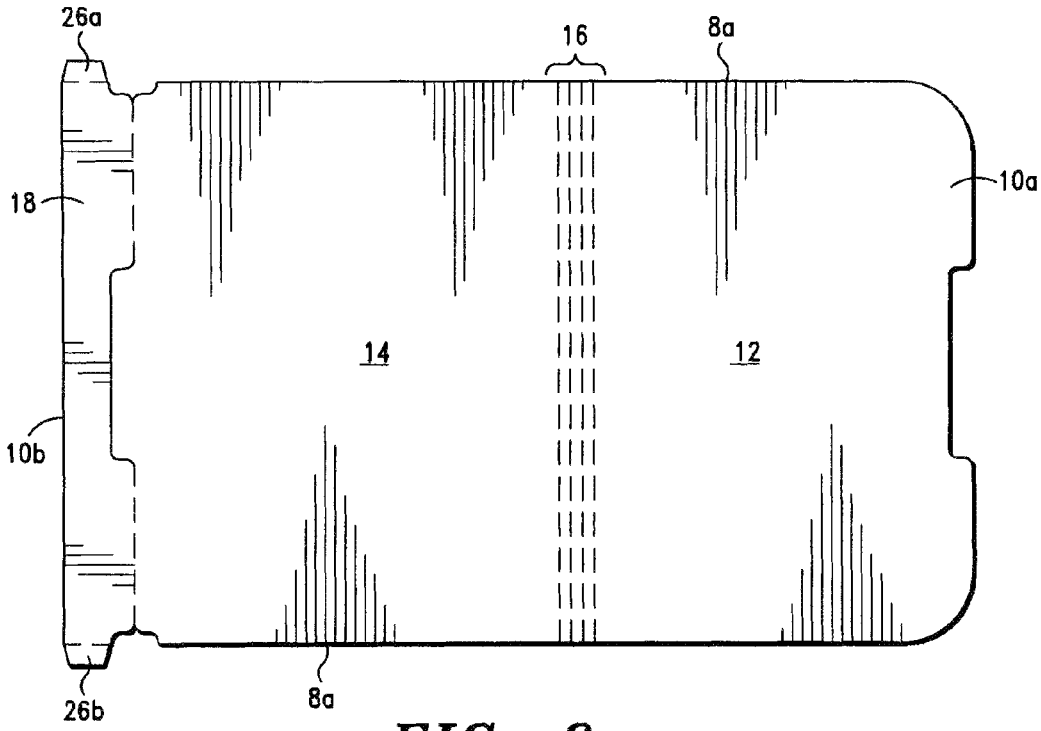
FIG. 6 is a top planar view of the unassembled file folder according to a second embodiment of the present invention.
Figure 8:
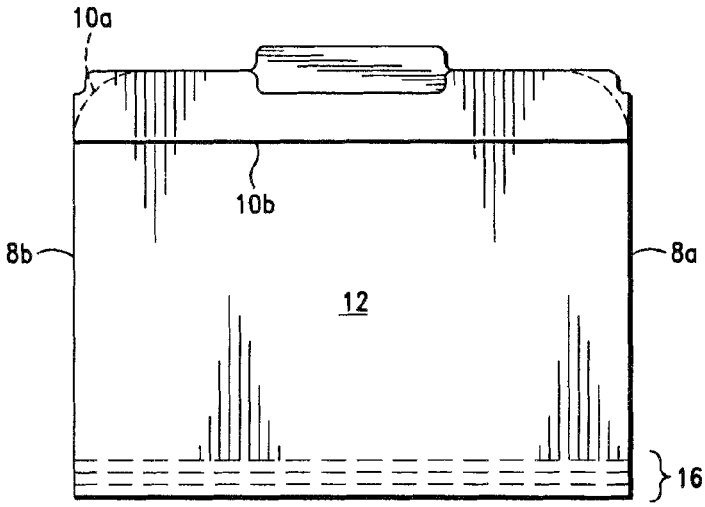
FIG. 8 is a front view of the assembled file folder of the second embodiment depicted in FIG. 3 in the closed position showing that portion of the front section inserted into the pocket in dotted lines.
Figure 7:
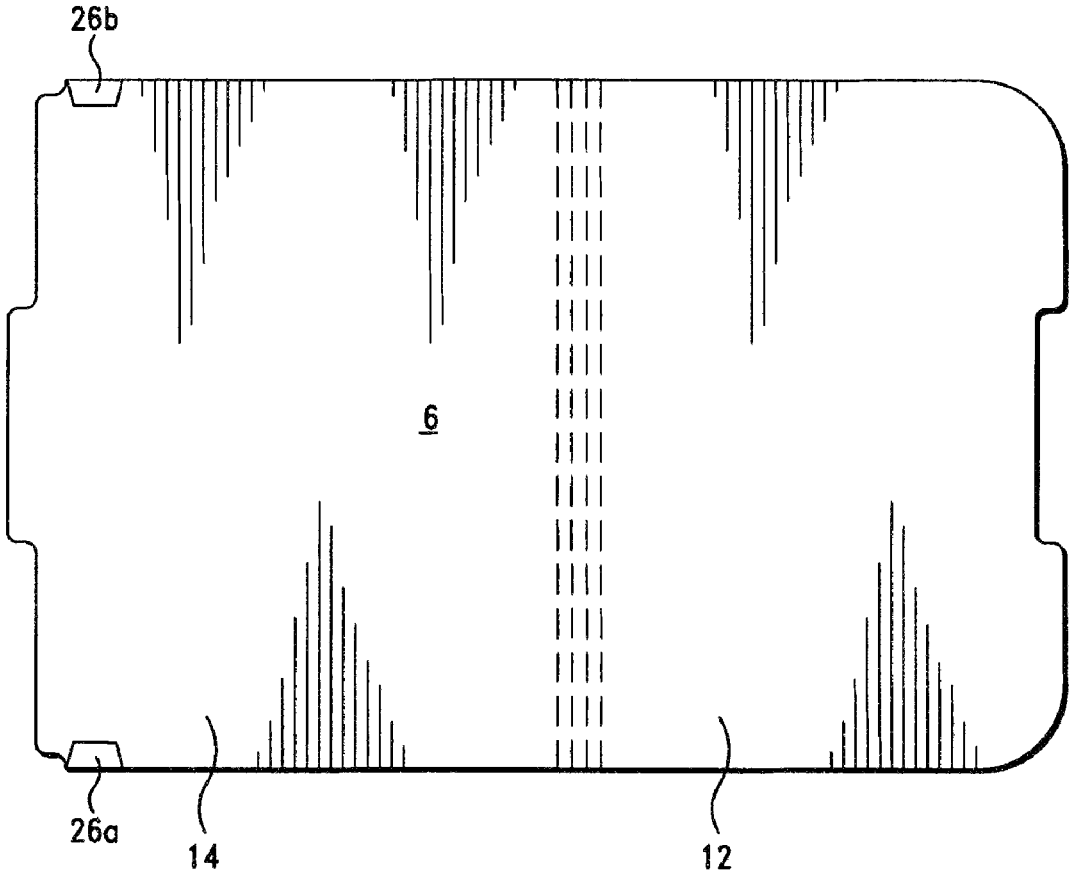
FIG. 7 is a bottom planar view of the assembled file folder of FIG. 6.

FIGS. 6-8 depict a second embodiment of the present invention that is similar to the first embodiment, with the exception that pocket tabs 26*a*, 26*b* extend outwardly from overlap section 18 along side edges 8*a*, 8*b*, and front section 12 has rounded corners at front edge 10*a* in lieu of the detail cut corners of the first embodiment. To assemble the second embodiment, as shown in FIG. 7, file folder 2 is folded as described above, except that pocket tabs 26*a*, 26*b* are folded around back of back section 14 and secured thereto with adhesive or other means known in the art.

A third embodiment of the present invention is depicted in FIGS. 9-12. As can be seen, the third embodiment is similar in basic structure to the second embodiment described above with the addition of a pocket flap 36 connected to overlap section 18 along a flap fold line 38. Flap 36 is defined by side edges 8*a*, 8*b* extending at an angle inwardly from flap fold line 38 to back edge 10*b*. Overlap section 18 and back section 14 are connected by pocket fold section 20, which is comprised of 3 scored fold lines 20', 20", 20'''. The base of index tab 30 is aligned with fold line 20''' closest to back section 14.

Pocket fold section 20 allows for expansion of the pocket 24 created by securing overlap section 18 and back section 14 together. The sides of pocket tabs 26*a*, 26*b* preferably taper inwardly toward the outer edge of the tabs such that the tabs are trapezoidal in shape with the side closest back section 14 extending inwardly at an angle (preferably approximately 15 degrees) greater than the angle of the side closest back edge 10*b* (preferably approximately 5 degrees). Pocket tabs 26*a*, 26*b* each have three scored fold lines 34*a*, 34*a*", 34''', 34*b*, 34*b*", 34*b*''' separating each pocket tab from overlap section 18 to accommodate the expansion capability of overlap section 18, and the pocket tabs 26*a*, 26*b* are sufficient in length to accommodate expansion of pocket 24. In addition, tapered fold lines 29*a*, 29*b* extending from the outer ends of pocket fold line 20''' to opposed side edges 8*a*, 8*b* respectively also assist in expansion of the file folder.

Figure 9:
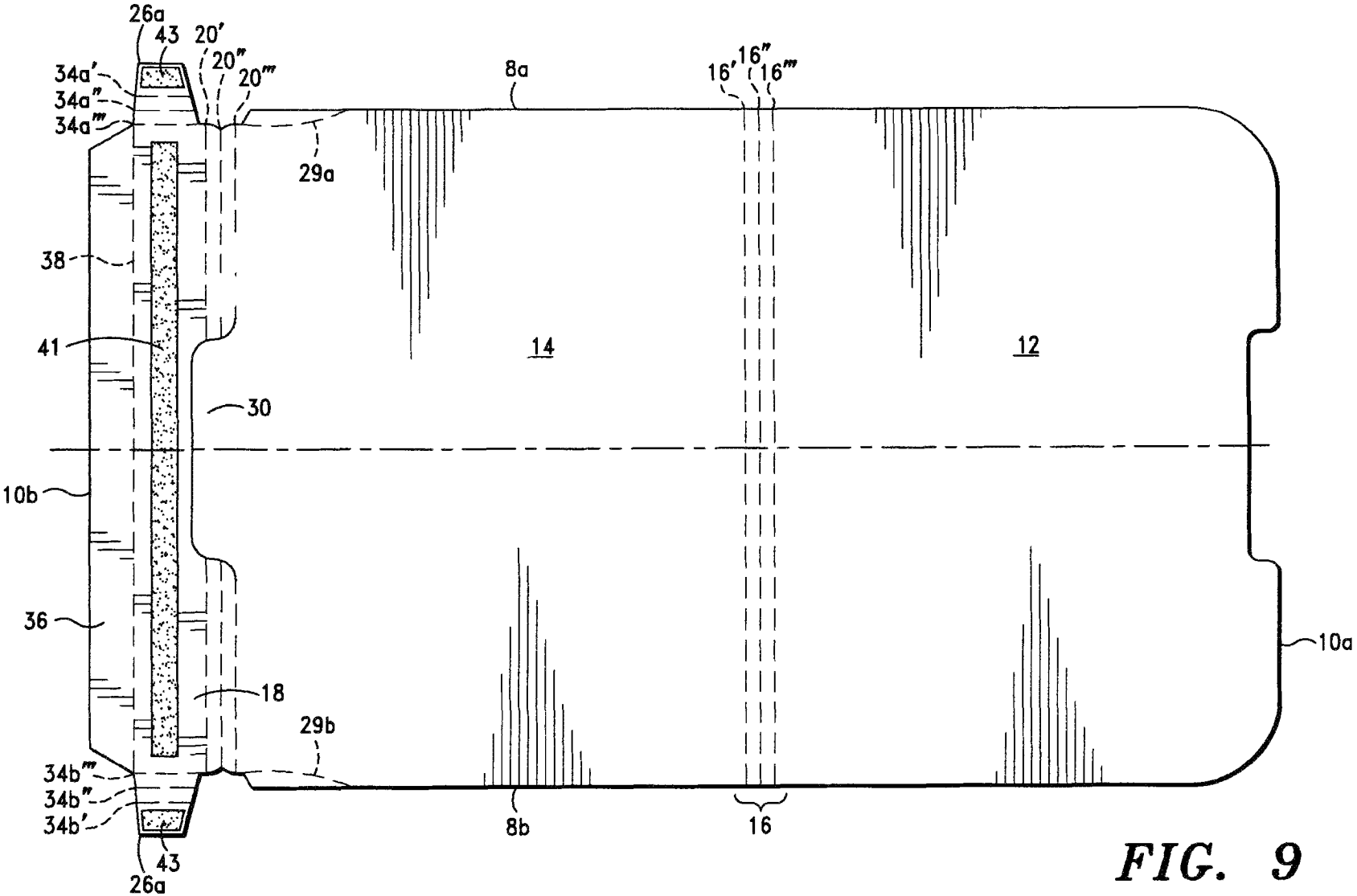
FIG. 9 is a top planar view of the unassembled file folder according to a third embodiment of the present invention.
Figure 10:
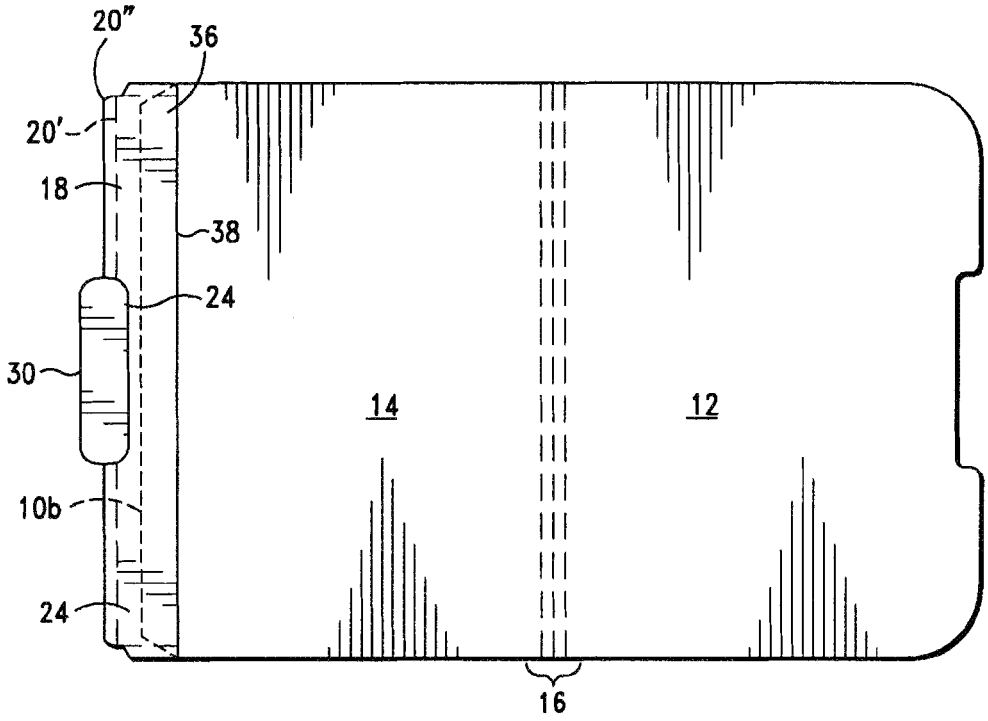
FIG. 10 is a top planar view of the assembled file folder of FIG. 9.
Figure 11:
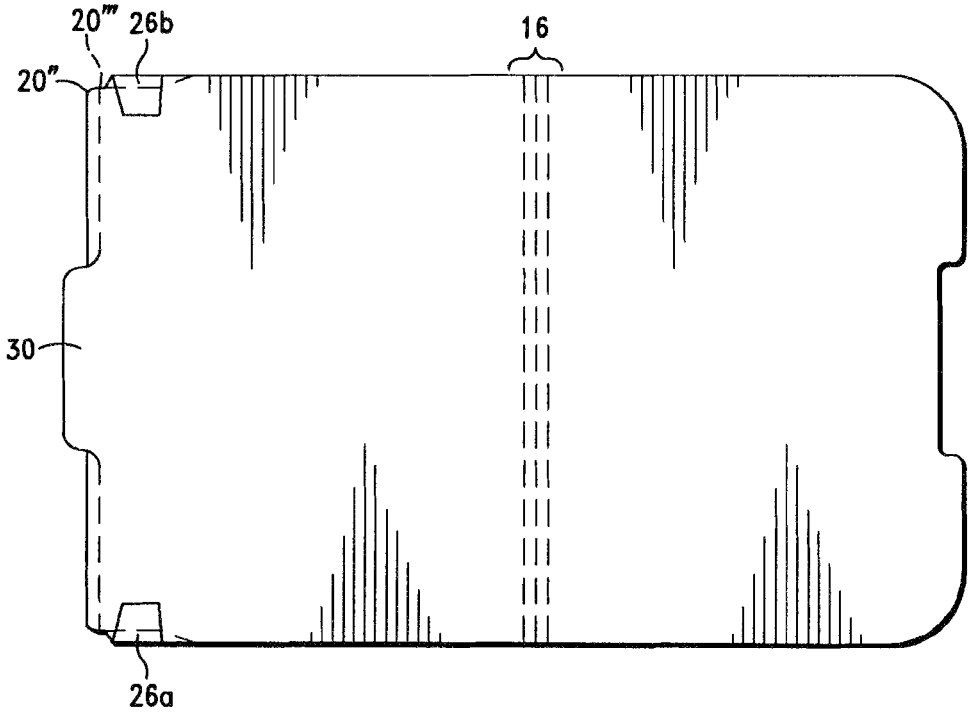
FIG. 11 is a bottom planar view of the assembled file folder of FIG. 9.
Figure 12:
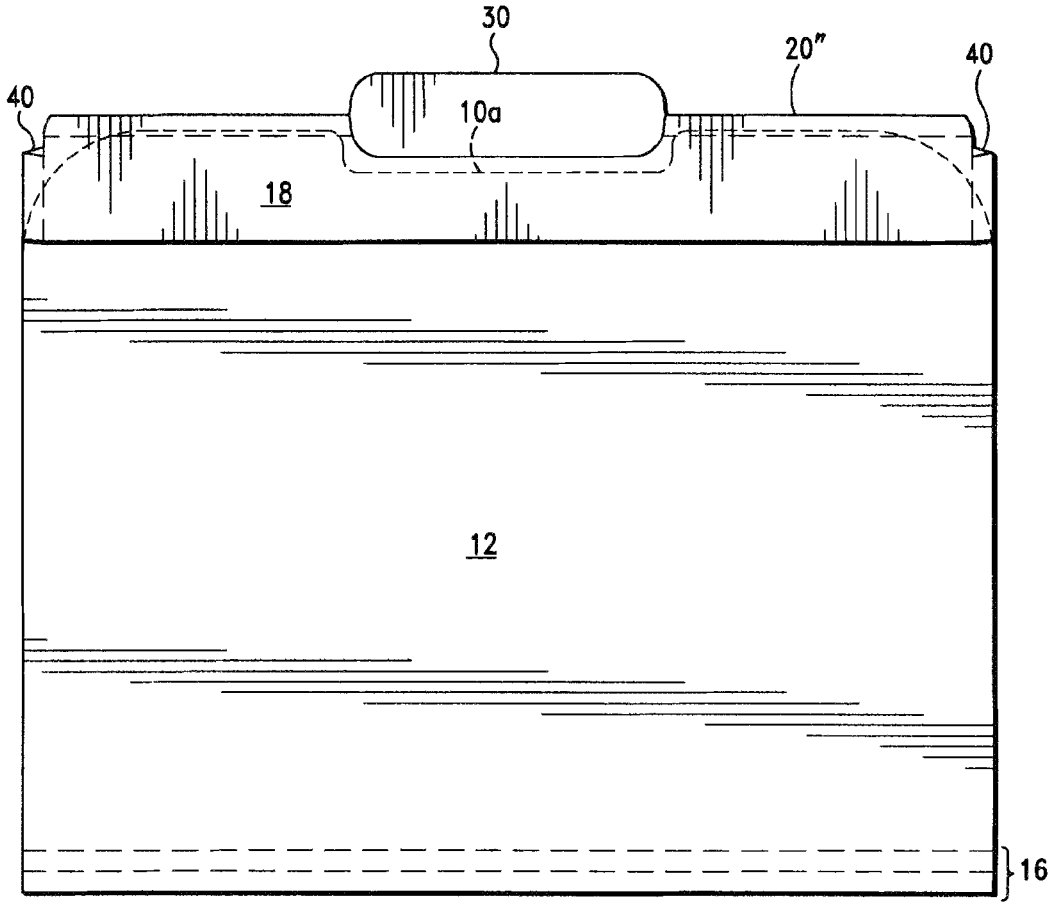
FIG. 12 is a front view of the assembled file folder of FIG. 9 in the closed position with that portion of the front section inserted into the pocket shown in dotted lines.

As shown in FIG. 9, center fold section 16 is comprised of 3 scored fold lines 16', 16", 16''' separating back section 14 and front section 12 to enable expansion of the folder. Although center fold section 16 preferably comprises 3 individual scored fold lines, it is within the scope of the present invention to have more than 3 or fewer than 3 fold lines. As shown in FIG. 12, apertures 40 are formed in the corners of file folder 2 between pocket tabs 26*a*, 26*b* and overlap section 18 when pocket 24 is expanded.

In assembly of the third embodiment, flap 36 folds over front of overlap section 18 at fold line 38 and is adhered thereto using adhesive 41 or other means known in the art. Overlap section 18 is then folded over the front of back section 14 and pocket tabs 26*a*, 26*b* are folded around the back of back section 14 at fold lines 34*a*, 34*b* and adhered thereto using adhesive 43 to form pocket 24, leaving open the edge formed by fold line 38 as the opening for the pocket.

Figure 13:
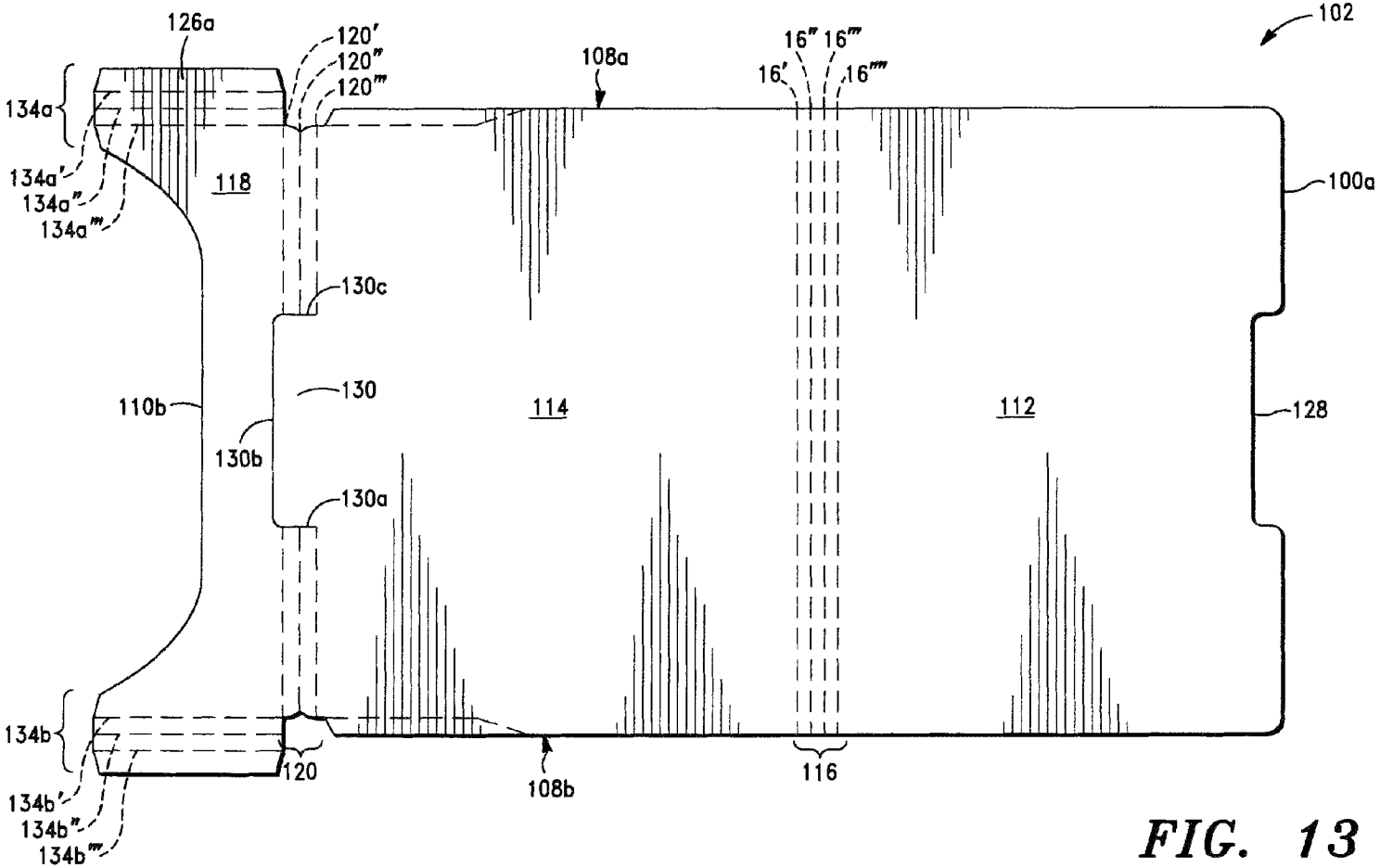
FIG. 13 is a top planar view of the unassembled file folder according to a fourth embodiment of the present invention.

FIGS. 13-17 depict a fourth embodiment of the present invention. Secure file folder 102 is formed from a single sheet of material and comprises front section 112 connected to back section 114 along center fold section 116. Back section 114 is connected to overlap section 118 along pocket fold section 120. As shown in FIG. 13, center fold section 116 is comprised of 4 individual scored fold lines 116', 116", 116''', 116'''' extending from side edge 108*a* to side edge 108*b* to enable the material to fold at one or more of the scored fold lines for expansion. Although 4 individual scored fold lines are preferred, only 1 scored fold line is necessary. As such, more than 4 or fewer than 4 fold lines may be utilized. Fold line 116', closest to back section 114, is preferably located at the approximate mid-point of the combined front and back sections of the file folder and will hereinafter be referred to as center scored fold line 116'. Additional scored fold lines 116", 116''', 116'''' are located forward of center fold line 116' toward front section 112. It is within the scope of the invention, however, for additional fold lines 116", 116''', 116'''' to be located on either side of center fold line 116' and still fall within the scope of the present invention.

Front section 112 is generally rectangular in shape defined by opposed side edges 108*a*, 108*b* extending from front edge 110*a* to fold line 116''''. Front edge 110*a* includes a cut out notch 128 near the longitudinal center of front edge 110*a* for viewing index tab 130 when file folder 102 is assembled. Notch 128 is approximately ⅓ the length of front edge 110*a* and approximately ½" deep. The corners of front edge 110*a* are preferably rounded in shape, as shown in FIG. 13. Back section 114 is generally rectangular in shape defined by opposed side edges 108*a*, 108*b* extending from center fold section 116 to pocket fold section 120.

Figure 15:
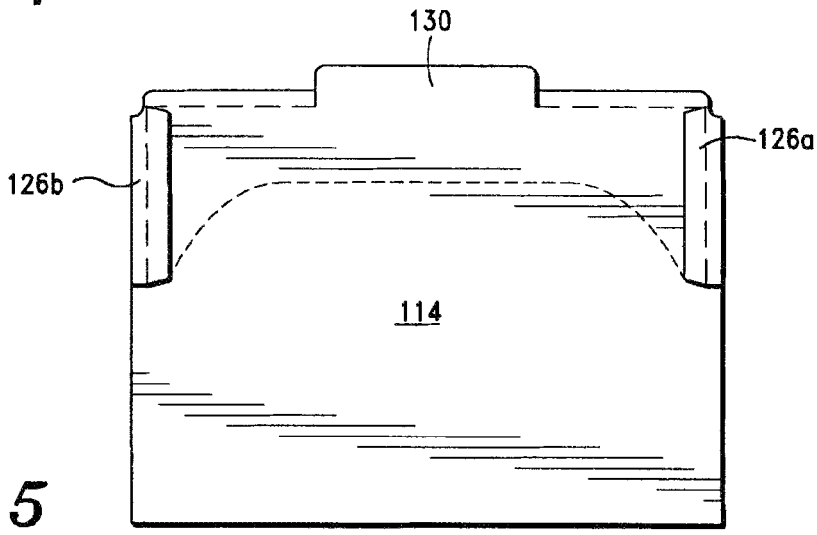
FIG. 15 is a back view of the assembled file folder of FIG. 13 in the closed position with the outer edge of the interior pocket shown in dotted lines.
Figure 16:
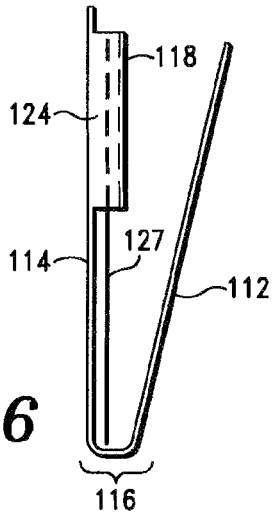
FIG. 16 is a side view of the assembled file folder of FIG. 13 with the file folder folded along center fold lines.
Figure 17:
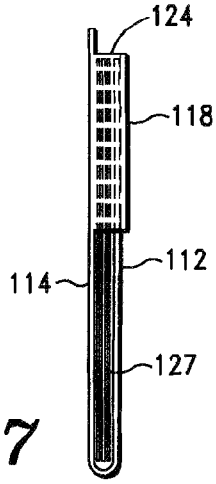
FIG. 17 is a side view of the assembled file folder of FIG. 13 with several sheets of paper inserted into the pocket and the front body section inserted into the pocket in the closed position.

Overlap section 118 is defined by opposed side edges 108*a*, 108*b* extending from pocket fold section 120 to back edge 110*b*. As shown in FIGS. 13 and 15, back edge 110*b* is concave in shape, extending inwardly toward back section 114 to enable the contents of pocket 124 to be at least partially viewed when the file folder is assembled. Overlap section 118 and back section 114 are separated by pocket fold section 120, consisting of 3 separate longitudinal scored fold lines 120', 120", 120''' to enable the material to fold at more than one of the scored fold lines for expansion. Although 3 scored fold lines are preferred, only 1 scored fold line is necessary. As such, more than 3 or fewer than 3 fold lines may be utilized. Fold line 120' is located closest back section 114 with additional fold lines 120", 120''', located above fold line 120' toward overlap section 118.

Figure 14:
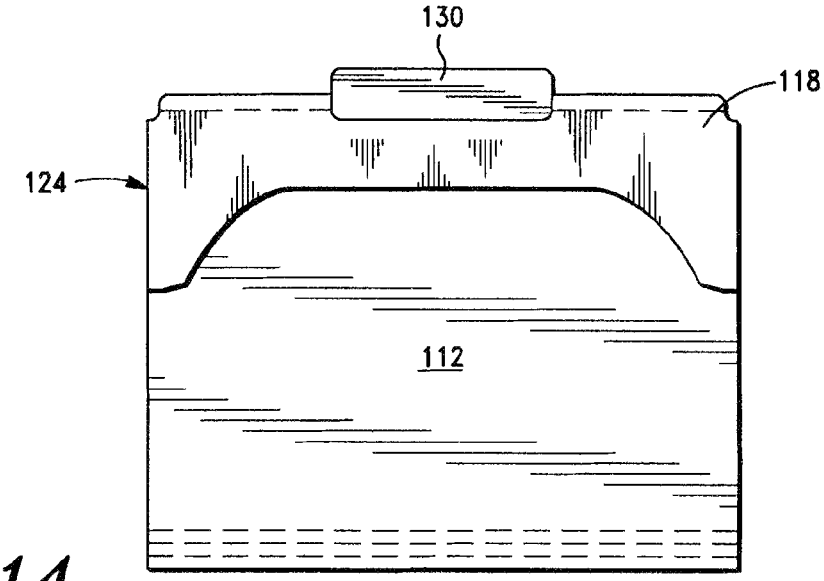
FIG. 14 is a front view of the assembled file folder of FIG. 13 in the closed position.

Index tab 130 is located between overlap section 118 and back section 114, along pocket fold section 120. Index tab 130 is located near the longitudinal center of pocket fold section 120 and is approximately ⅓ the length of pocket fold section 120. Index tab 130 has 3 free edges 132*a*, 132*b*, 132*c* which are cut free from the sheet material to allow overlap section 118 to fold over index tab 130, thereby exposing index tab 130. Index tab 130 is integral with back section 114 at the base of index tab 130, and aligns with fold line 120'. As shown in FIG. 14, when folder 102 is assembled, index tab 130 will extend outwardly from back section 114 and will be visible from the front of the folder through notch 128.

Looking to FIGS. 13 and 15, a pair of pocket tabs 126*a*, 126*b* extend outwardly from overlap section 118 along side edges 108*a*, 108*b*. Pocket tabs 126*a*, 126*b* are separated from overlap section 118 by tab fold sections 134*a*, 134*b*, each comprised of 3 individual scored transverse fold lines 134*a'*, 134*a"*, 134*a'''*, 134*b'*, 134*b"*, 134*b'''* and are slightly trapezoidal in shape, narrowing from the outer fold line 134*a'*, 134*b'* toward the outer edge of the pocket tabs at an angle of approximately 15 degrees.

During assembly, overlap section 118 is folded along pocket fold section 120 over index tab 130 and onto front of back section 114. Pocket tabs 126*a*, 126*b* are folded over back of back section 114 along tab fold sections 134*a*, 134*b* and secured thereto with adhesive or other means known in the art, forming expandable pocket 124 with curved edge 110*b* free for insertion of one or more sheets of paper 127 and for insertion of front section 112 to releaseably secure the file folder in the closed position.

It should be noted that the assembled size of folder 2, 102 may be any size adequate to accommodate the papers intended to be inserted in the pockets. Preferably, the assembled size of folder 2, 102 is sufficient to accommodate letter-sized papers measuring approximately 8½"×11". It is also within the scope of the present invention for folder 2, 102 to be sized to accommodate legal-sized papers measuring approximately 8½"×12" or oversized-papers having greater measurements.

Although specific combinations of an index tab, notch, pockets and pocket tabs have been described, it is within the scope of the present invention to utilize any number of combinations of the index tab, notch, pockets and pocket tabs heretofore described to create a wide variety of file folders. It should be understood that these elements may be of varying shapes, sizes and locations on the file folder without departing from the invention.

For all embodiments, outer corners of folder 2, 102 can be various shapes such as detail cut in a flattened "S" shape, rounded, square, angle-cut or virtually any shape that is easily manufactured. It should also be noted that the specific contour of the free corners of the front section 12, 112 may be virtually any shape, such as rounded, detail-cut, angled, square and the like.

It should be noted that for the fourth embodiment, the shape of the outer edge of overlap section 18, 118 could be a shape other than a concave curve. For example, the shape of the overlap section outer edge could be square, angled, straight, and the like. A curved profile, however, is preferred for ease of manufacture and to reduce the occurrence of paper cuts and ripping of the folder.

Although the index tab 30, 130 and corresponding notch 28, 128 have been described as being located in the approximate longitudinal center of folder 2, 102, it is also within the scope of the present invention for index tab 30, 130 and corresponding notch 28, 128 to be located closer towards one side of folder 2, 102.

In the manufacture of the present invention embodiments, a single sheet of material is die cut into the specific patterns described above and shown in the layout figures. Folder 2, 102 is then assembled by folding the respective overlap sections 18, 118 along the appropriate fold lines or scored sections and adhering the pocket tabs 26*a*, 26*b*, 126*a*, 126*b* to the folder—either on the back of back section 14, 114 and front section 12, 112 or the back of overlap sections 18, 118—to form pockets 24, 124. While the tabs are preferable secured using an adhesive, such as hot melt or water based adhesives, it should be understood that any other means known in the art for securing the tabs would be suitable for purposes of this invention, including the use of staples, ultrasonic welding, or rivets. In addition, it is within the scope of this invention to use a releasable securing means such as Velcro or to integrally form a securing means within the sheet of material such as by die cutting a notch and slot attachment means formed within the sheet material.

The file folder may be formed of any suitable sheet material, such as paper, card stock, Mylar, polypropylene or polyvinylchloride. The preferred sheet material is conventional file folder material such as card stock or polypropylene, and most preferably 11 point manila cardstock. White or colored cardstock could also be utilized.

From the foregoing, it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. It should be understood that the various features described with respect to the alternative embodiments may be combined with the various features described with respect to the preferred embodiment, such that any combination of the features described herein is contemplated by the present invention. This is contemplated by and is within the scope of the claims.

What is claimed and desired to be secured by Letters Patent is as follows:

1. A file folder comprising:

a first body section having a free front edge, a back edge and opposed side edges;

a second body section having a front edge, a back edge and opposed side edges, wherein said front edge of said second body section is connected to at least a portion of said back edge of said first body section along at least one center fold line;

an index tab extending outwardly from said back edge of said second body section;

a notch in the free front edge of said first body section corresponding with said index tab;

an overlap section having a front edge, a free back edge and opposed side edges, wherein said front edge of said overlap section is connected to at least a portion of said back edge of said second body section along a pocket fold line, and wherein said overlap section is positioned in overlapping relationship with a pocket portion of said second body section with the free back edge of said overlap section positioned in overlapping relationship with the second body section;

side tabs extending between the opposed side edges of said pocket portion of the second body section and corresponding opposed side edges of the overlap section in a manner to secure the second body section and overlap section in overlapping relationship to define an enclosed pocket area;

said enclosed pocket area bounded by said overlap section, said pocket portion of the second body section, said pocket fold line and said side tabs, and wherein said enclosed pocket area is accessible through an unrestricted opening presented between the second body section and the overlap section along the free back edge of the overlap section; and said enclosed pocket area being configured such that the free front edge of the first body section may be inserted into the opening of the enclosed pocket area and a portion of the first body section corresponding in size to the pocket portion of the second body section may be positioned within the enclosed pocket area to releaseably secure the file folder in a closed position.

2. The file folder of claim 1, wherein the second body section is connected to the first body section along two or more central fold lines to enable expansion of said file folder.

3. The file folder of claim 1, wherein the overlap section is connected to the second body section along two or more pocket fold lines to enable expansion of said pocket.

4. The file folder of claim 1, wherein said side tabs have two or more tab fold lines to enable expansion of said enclosed pocket area.

5. A file folder, comprising:

a sheet of material having a front surface and a back surface and defined by first and second opposed sides extending between first and second ends, said sheet comprising:

a first body section;

a second body section connected to said first body section along at least one central fold line extending from said first opposed side to said second opposed side of the sheet;

at least one overlap section connected to said second body section along at least one overlap fold line extending from the first opposed side to the second opposed side of said sheet, wherein said sheet is folded along said at least one overlap fold line such that said overlap section is in an overlapping position with a pocket portion of said second body section;

index tab die cut lines configured to form an index tab over which said overlap section is folded into the overlapping position such that said index tab extends outwardly from said second body section when secured in the overlapping position;

wherein said sheet additionally comprises a first tab extending between and securing the overlap section and the pocket portion of the second body section along said first opposed side and a second tab extending between and securing the overlap section and the pocket portion of the second body section along said second opposed side in a manner to define an enclosed pocket area between the overlap section and the pocket portion of the second body section;

wherein said sheet is configured such that said first body section can be folded over said second body section along said at least one central fold line and a portion of said first body section corresponding in size to said pocket area may be inserted between said second body section and said overlap section within the enclosed pocket area to releaseably close said file folder; and wherein said first end additionally comprises a notch positioned along said first outer edge such that said index tab is visible through said notch when said first body section is folded over said second body section along said at least one central fold line.

6. The file folder of claim 5, wherein said at least one overlap fold line comprises two or more overlap fold lines to enable expansion of said enclosed pocket area.

7. The file folder of claim 5, wherein said at least one central fold line comprises two or more central fold lines to enable expansion of said file folder.

8. The file folder of claim 5, wherein said side tabs extend outwardly from said body section and wherein said side tabs are secured to said overlap section to secure the sections in the overlapping position.

9. The file folder of claim 5, wherein said side tabs extend from said second body section and wherein said side tabs are secured to said overlap section to secure the sections in the overlapping position.

10. The file folder of claim 5, wherein said material is selected from the group consisting of paper, cardstock, Mylar, polypropylene or polyvinylchloride.

* * * * *